US005376037A

United States Patent [19]

Finkbeiner

[11] Patent Number: 5,376,037

[45] Date of Patent: Dec. 27, 1994

[54] CONTINUOUS BELTWAY AND TRACK SECTIONS FOR FORMING THE BELTWAY AND A METHOD OF USING THE SAME

[76] Inventor: Ernest Finkbeiner, 18841 Arbor Bl., Grayslake, Ill. 60030

[21] Appl. No.: 22,448

[22] Filed: Feb. 25, 1993

[51] Int. Cl.[5] ..... A63H 1/00; A63H 18/00; A63F 9/14

[52] U.S. Cl. ..... 446/236; 446/444; 273/86 B

[58] Field of Search ..... 446/236, 91, 39, 136, 446/135, 134, 444, 446, 447, 467, 476; 273/86 B, 86 F; 104/172.3, 172.2, 173.1

[56] References Cited

U.S. PATENT DOCUMENTS

| | | | |
|---|---|---|---|
| 350,168 | 10/1886 | Stewart | 104/178 |
| 848,408 | 3/1907 | Taylor | 104/172.3 X |
| 1,032,096 | 7/1912 | Taylor | 104/172.3 X |
| 1,065,407 | 6/1913 | Roed | 104/172.3 |
| 1,083,308 | 1/1914 | Thurston | 104/172.3 X |
| 1,358,305 | 11/1920 | Feltman | 104/172.3 X |
| 1,690,409 | 11/1928 | Heyman | 104/173.1 |
| 1,704,012 | 3/1929 | Marx | 104/173.1 X |
| 2,008,390 | 7/1935 | Harris | 446/447 X |
| 2,554,211 | 5/1951 | Pogreba | 273/86 F |
| 2,602,262 | 7/1952 | Nichols | 273/86 F |

FOREIGN PATENT DOCUMENTS

| | | | |
|---|---|---|---|
| 1008287 | 5/1952 | France | 273/86 B |
| 1288030 | 2/1962 | France | 446/447 |

*Primary Examiner*—Robert A. Hafer
*Assistant Examiner*—D. Neal Muir
*Attorney, Agent, or Firm*—Hill, Steadman & Simpson

[57] ABSTRACT

A beltway system is provided having distinct track sections which may be interconnected to form a beltway of varying sizes and configurations. The system includes a motor which connects to a primary pulley, and a timing belt is connected to secondary pulleys and the primary pulley for each of the track sections. The secondary pulleys are further connected to forwarding belts for synchronized advancement of racing elements connected thereto. Adjacent track sections meet at junctions which may be obscured by a structure such that the track sections appear to be continuous.

15 Claims, 3 Drawing Sheets

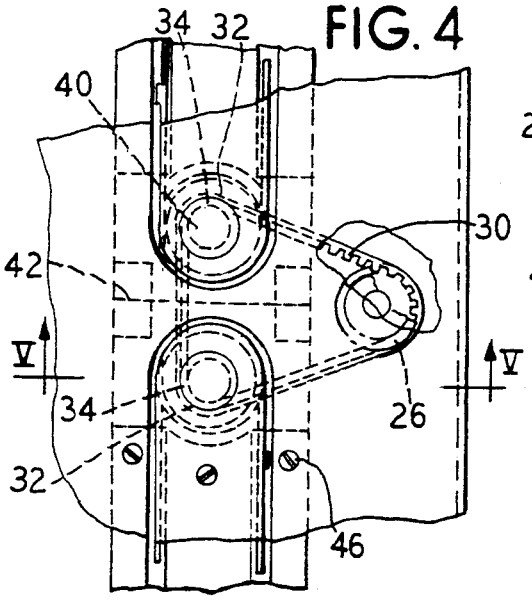
FIG. 4
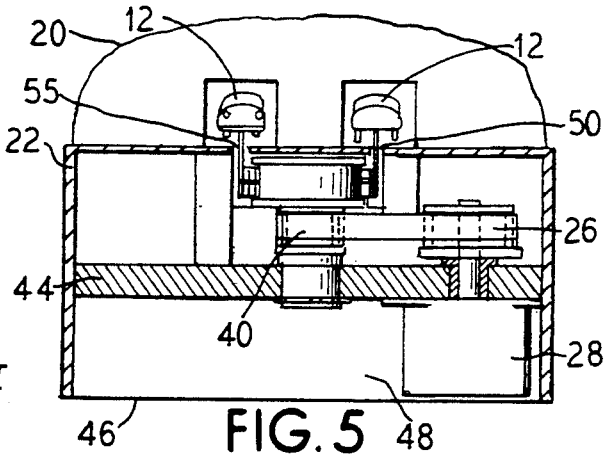
FIG. 5
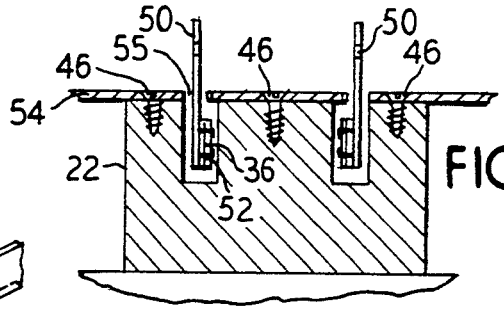
FIG. 6
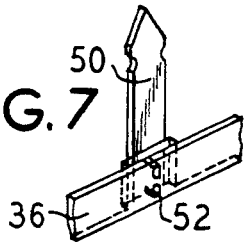
FIG. 7
FIG. 8
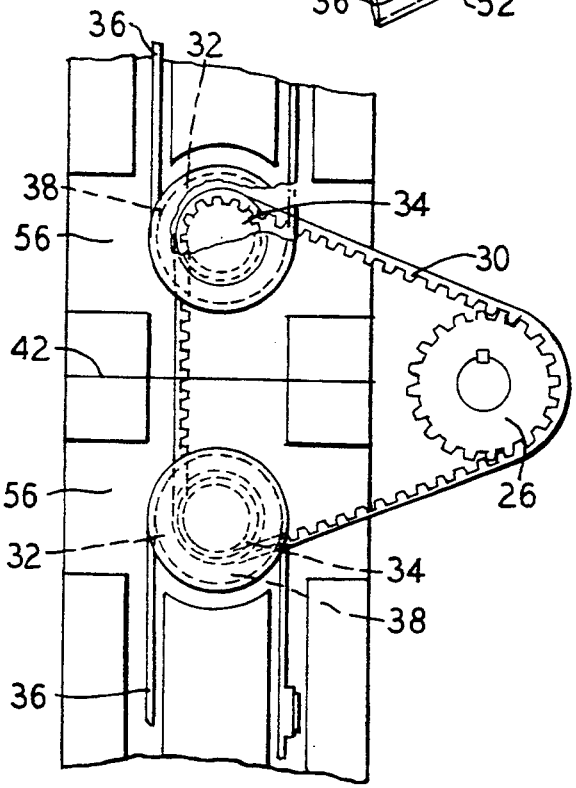
FIG. 9
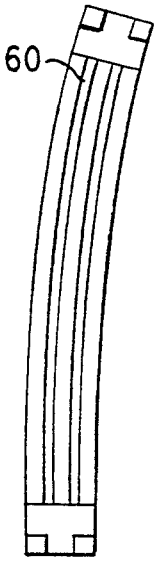
FIG. 10
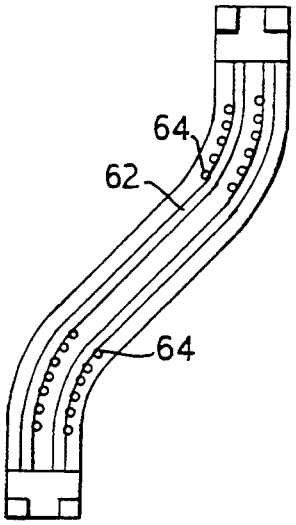

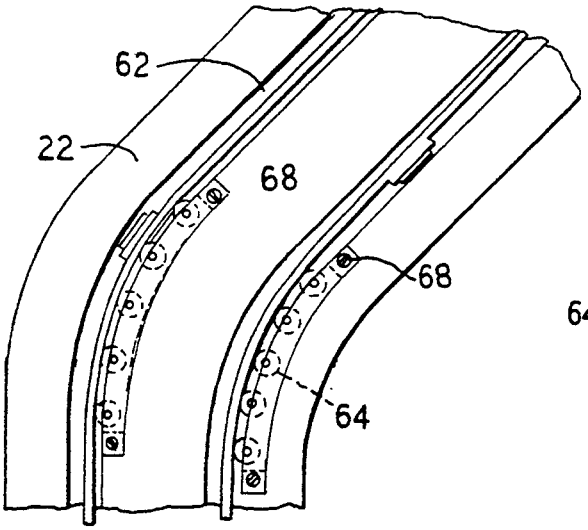
FIG. 11
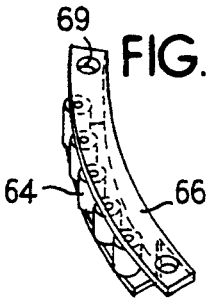
FIG. 12
FIG. 13
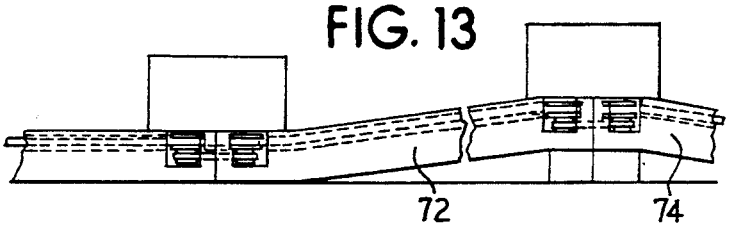
FIG. 14
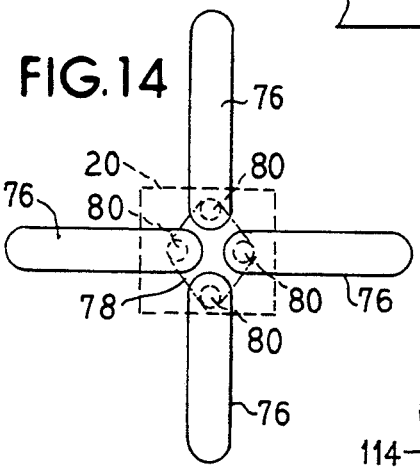
FIG. 15
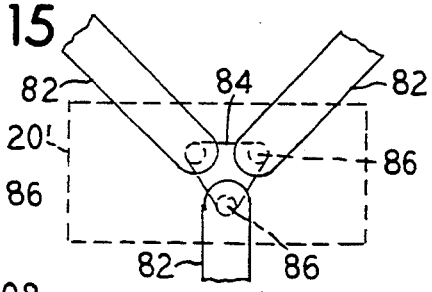
FIG. 16
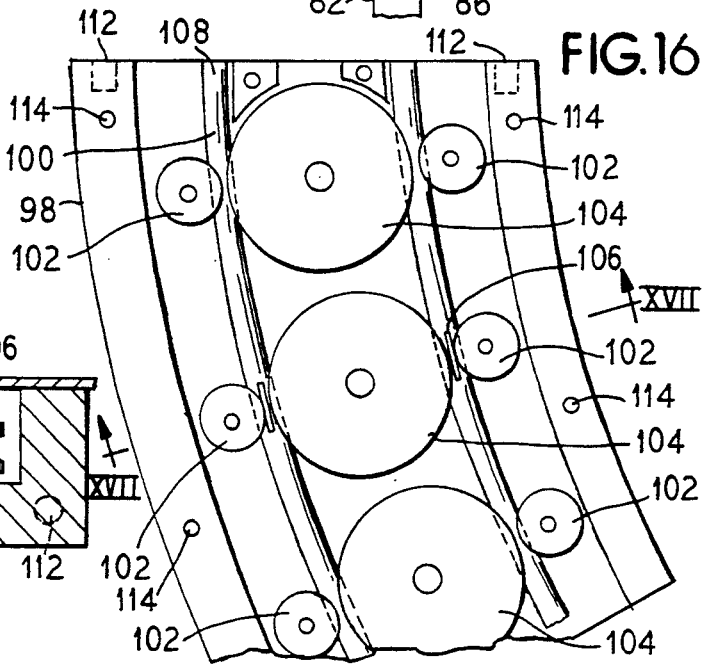
FIG. 17
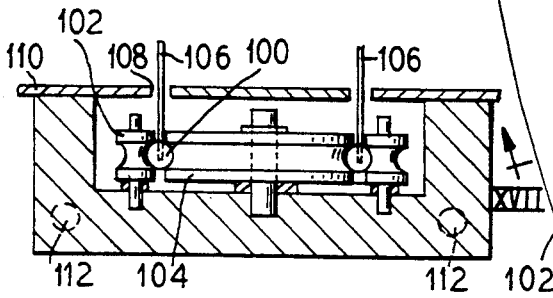

CONTINUOUS BELTWAY AND TRACK SECTIONS FOR FORMING THE BELTWAY AND A METHOD OF USING THE SAME

BACKGROUND OF THE INVENTION

The present invention generally relates to a continuous beltway. More specifically, the invention relates to a plurality of segments for forming a beltway by interconnecting the segments to form various lengths and particular configurations.

It is known in the prior art to provide a track system including miniaturized automobiles, miniaturized trucks, miniaturized trains or the like. Such systems often simulate a realistic setting by including model-type scenery adjacent the track and/or between tracks. Such sets may typically be available for display, amusement and/or general collection.

However, previously known sets which include scenery, tracks and miniaturized vehicles for operating on the track typically require a substantial amount of time in assembling the track and connecting the same to a source of electrical power. In addition, changing the size of the track is often difficult without repositioning a majority of sections of track which have been previously positioned. Furthermore, prior art beltways have only a limited number of variations for changing scenery, track configurations, track lengths, track gradients, track curvature and the like.

A need exists, therefore, for an improved beltway system which overcomes the deficiencies of the prior art.

SUMMARY OF THE INVENTION

In accordance with the invention, a beltway system is provided for advancing at least one racing element on a plurality of tracks wherein a housing having a top wall with a slotted section forms the tracks. The tracks meet at a common junction wherein the racing elements on adjacent tracks are reversed at the common junction. A forwarding belt is operatively connected to each of the racing elements for advancement of the racing elements on the tracks. A motor is connected to a timing belt and a primary pulley. A secondary pulley is operatively connected to each of the forwarding belts of the respective tracks and a timing belt for synchronized control of the forwarding belts for each of the tracks.

In an embodiment, the tracks may include sections having curves or may include sections having gradients.

In a further embodiment, at least three tracks may intersect at the common junction.

In yet another embodiment, an obscuring structure may be mounted on the housing at the common junction such that the racing elements on adjacent tracks which meet at the common junction appear to be moving continuously on a single track.

In another embodiment, a plurality of elliptical track sections including racing elements is provided with a housing. A common junction defines an area at which adjacent track sections meet. An obscuring structure is mounted on the housing at the common junction and is constructed and arranged such that the racing elements on adjacent track sections reverse their directions.

Further, in accordance with the invention, a method is provided for providing at least two elliptical track sections and forwarding belts for each of the track sections for advancement of racing elements operatively connected to the forwarding belts. A structure is further provided intermediate the track sections for obscuring an area about which the racing elements change their directions on their respective track sections such that the track sections appear to be continuous.

It is, therefore, an advantage of the present invention to provide a beltway system including easily interchangeable track sections so as to provide varying track configurations and sizes thereof.

Further, an advantage of the present invention is to provide a beltway system which may include curves and/or gradients on portions of track sections.

A further advantage is to provide track sections and racing elements on the track sections with relatively few parts.

Moreover, an advantage of the present invention is to provide a housing for enclosing the mechanical portions of the beltway system so as to provide an aesthetically pleasing beltway system.

A still further advantage of the present invention is to provide a beltway system that may be easily assembled and disassembled including variations in scenery and variations in racing elements.

Numerous other advantages and features of the present invention will become readily apparent from the following detailed description of the invention and the embodiments thereof, from the claims and from the accompanying drawings in which the details of the invention are fully and completely disclosed as part of this specification.

BRIEF DESCRIPTION OF THE DRAWINGS

FIG. 4 is an enlarged fragmentary plan view of the junction of two sections of the beltway system of the present invention.

FIG. 5 is a sectional view taken generally along the line V—V of FIG. 4.

FIG. 6 is a partial sectional view of the assembly of a post which secures a vehicle to a forwarding belt of the track of the present invention.

FIG. 7 is a perspective view of a post for operatively connecting a racing element with a forwarding belt of the present invention.

FIG. 8 illustrates a plan view of the junction of two sections of the beltway of the present invention.

FIG. 9 is a plan view of a curved guide rail for a track having moderate curvature for an embodiment of the present invention.

FIG. 10 is a plan view of an S-curve guide rail for a track for an embodiment of the present invention.

FIG. 11 is an enlarged plan view of a portion of a track having a sharp turn or other curve for an embodiment of the present invention.

FIG. 12 is a perspective view of an insert including a bracket and rollers for securing to a curve in a guide rail in an embodiment of the present invention.

FIG. 13 is a side cross-sectional view of an embodiment of the track of the present invention having built-in gradients.

FIG. 14 is a plan view of an alternate embodiment of the present invention of a beltway system having a common junction between multiple track sections.

FIG. 15 is another partial plan view of an alternate embodiment for the beltway system of the present invention having a common junction between multiple track segments.

FIG. 16 is a top plan view of another embodiment for a curved section for a portion of a track of the beltway of the present invention.

FIG. 17 is a sectional view taken generally along the line XVII—XVII of FIG. 16.

DETAIL DESCRIPTION OF THE PRESENTLY PREFERRED EMBODIMENTS

Figure 1:
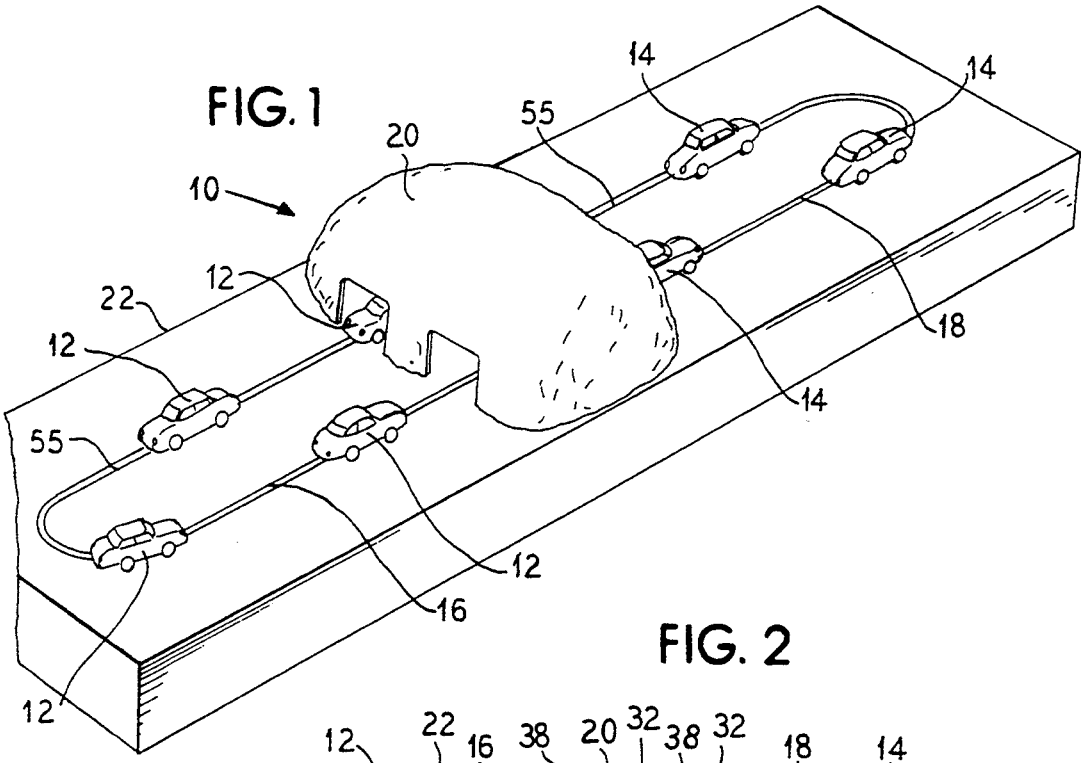
FIG. 1 is a perspective view of a beltway system of the present invention having a single obscured area at a junction of two tracks.

As illustrated in FIG. 1, a beltway system 10 is generally shown. The beltway system 10 includes a plurality of racing elements 12 and 14. The beltway system 10 includes two adjacent track sections 16 and 18 connected at a junction point therebetween explained in further detail hereinafter. The elements 12 and 14, as illustrated, are miniaturized automobiles. It will be appreciated, however, that other miniaturized elements, such as trucks, vans, motorcycles, bicycles, train cars, horses, or the like may be substituted for any one or all of the racing elements 12 or 14.

The first racing elements 12 travel about the first track section 16, and the second racing elements 14 travel about the second track section 18. Intermediate the first track section 16 and the second track section 18 at the junction point therebetween is an obscured area 20. The obscured area 20 is designed so as to lead an observer operating the system 10 to believe that the beltway system 10 is a single, continuous track rather than, in fact, the two track sections 16 and 18. The obscured area 20, as shown, is a short two-way tunnel which covers the junction point of the track section 16 and the track section 18. At this point, that is, in the obscured area 20, the racing elements 12 and 14 of the track sections 16 and 18, respectively, alter their course of travel 180° in the embodiment shown. In addition, a variety of obscured areas are contemplated such as toll plazas, tunnels through a mountain, intersections, overpasses including other tracks or bridges, custom and passport control buildings, buildings which include tunnels, or the like.

The track sections 16 and 18 as well as the obscured area 20 may be mounted on a housing 22. The housing 22 may further include scenery, such as rock formations, small hills, dense forests, farmhouses, buildings, or the like between the tracks of the track sections 16 and 18 or outside of the track sections 16 and 18 either on or off of the housing 22. The controls (not shown in FIG. 1) for controlling movement of the racing elements 12 and 14 around the track sections 16 and 18 are contained within the housing 22 and are, therefore, obscured by the housing 22 and/or the obscured area 20 when in operation.

Figure 2:
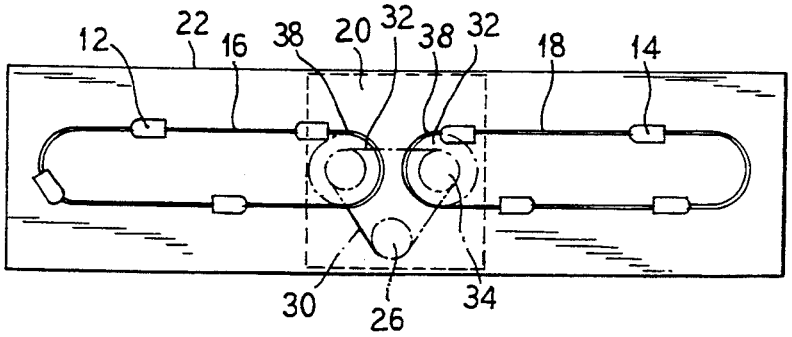
FIG. 2 is a top plan view of the beltway system of FIG. 1.
Figure 3:
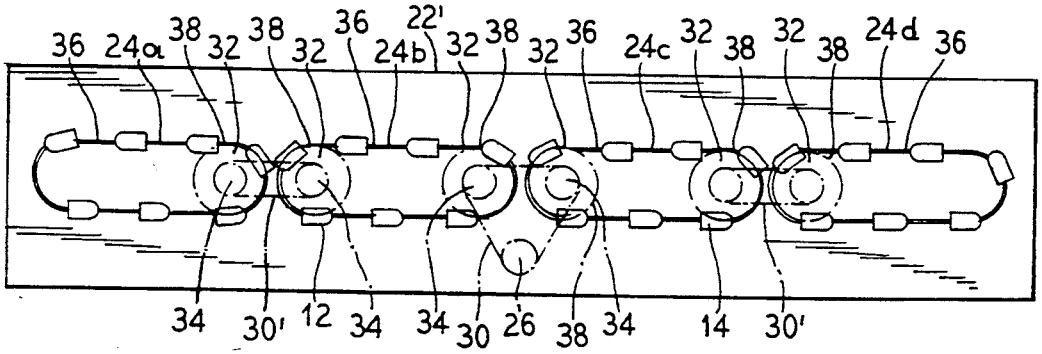
FIG. 3 is an alternate embodiment of the beltway systems of the present invention illustrating four track sections interconnected.

As illustrated in FIGS. 2–8, a control section beneath the obscure area 20 is shown. One control section is required between each of the track sections 16 and 18 as shown in FIG. 2. Alternatively, FIG. 3 illustrates four track sections 24*a*, 24*b*, 24*c* and 24*d* having three control sections therebetween.

At the junction of the track sections 16 and 18, the control sections comprise a set of pulleys and belts. A drive pulley 26 is connected to a motor 28 as shown in FIG. 5. A timing belt 30 may be operatively connected to the drive pulley 26 and a dual section pulley 32 of each of the track sections 16 and 18. The timing belt 30 is connected to a lower portion 34 of the pulley 32, and a forwarding belt 36 is connected to an upper portion 38 of the pulley 32.

The dual-section pulley 32 and the drive pulley 26 may be constructed of an aluminum or reinforced nylon, but other materials may be used as is known in the art. A stationary axle 40, generally of stainless steel, but other reinforced hardened materials may be used, is provided around which the pulley 32 may rotate. The forwarding belt 36 may be secured around the upper portion 38 of the pulley 32 and may be constructed from a reinforced vinyl material which prevents slippage when the forwarding belt 36 is in motion about the pulley 32.

FIG. 3 illustrates the four track sections 24*a*, 24*b*, 24*c*, and 24*d* including three pairs of dual section pulleys 32. One pair of pulleys 32 is situated between two adjacent tracks, such as the pulleys 32 between tracks 24*a* and 24*b*. Generally, only a single motor 28, as shown in FIG. 5, is connected to the drive pulley 26, but a plurality of motors may be implemented as desired. The timing belt 30 may be included with the central section including the drive pulley 26. Timing belts 30′ are also included in the other sections between the pair of pulleys 32 which are located between adjacent track sections, such as the track sections 24*a* and 24*b* or the track sections 24*c* and 24*d*.

The pulleys 32 for these adjacent track sections may also be divided into two portions, a lower portion 34 connected to the timing belt 30′, and an upper portion 38 which is connected to the forwarding belt 36. Each forwarding belt 36, therefore, forms a means on which the racing elements, such as the racing elements 12 and 14 on the track sections 24*b* and 24*c*, respectively, are transported about the track sections.

Referring now to FIG. 4, an enlarged view of the control section is generally shown. The drive pulley 26 has the timing belt 30 secured therearound which is further connected to the lower portion 34 of each of the pulleys 32. The drive pulley 26 may be geared with teeth to engage corresponding openings in the timing belt 30 for advancement thereof. Other pulley and belt arrangements are contemplated as is generally known for advancement of the racing elements on their respective forwarding belts.

As further illustrated in FIG. 4 and also illustrated in FIG. 8, the housing 22 supporting the track sections 16 and 18 may be separable at a dividing line 42 and may be secured to a stationary base 44 by screws 46 or other known means for securing. The base 44 is somewhat elevated from the floor 46 of the housing 22 so as to provide an area 48 for the motor 28 to run.

Each of the racing elements 12 may be secured to a post 50 as shown in FIGS. 5–7. The post 50 may be a rigid plate which is secured to the forwarding belt 36 by a staple 52 or other like fastening means for rigid and secure connection thereto.

The housing 22 as shown in FIG. 6 includes a top wall 54 connected to the housing 22 by the screws 46. The housing 22 may be molded nylon or other rigid material and the top wall 54 may be an FGR thermal setting material or other like material. The housing 22 includes slots 55 for the posts 50 to protrude therethrough for securement of a racing element 12, such as an automobile. The forwarding belt 36 is secured to the post 50 by a staple 52 or like element.

As shown in FIG. 8, open areas 56 are generally shown. The areas 56 enable simple attachment of the timing belt 30 to the lower portions 34 of each dual section pulley 32 as well as around the drive pulley 26. Furthermore, the forwarding belt 36 may be secured about the upper portion 38 of the dual-section pulleys 32 through the open areas 56.

As illustrated in FIGS. 9 and 10, sections 60 and 62 of tracks are generally shown. The gently curved track section 60 shown in FIG. 9 and the S-curved track section 62 shown in FIG. 10 may be implemented along a portion of the length or the entire length of the track. That is, the track sections 60 and 62 may be included between obscured areas or junction points as previously discussed. The curved track section 60, as shown in FIG. 9, has a gently radiused edge for either left and/or right curves. The curved track section 60 is constructed in the same manner as a straight rail which has been previously discussed with reference to FIGS. 1–8. The curved track section 60 may be converted from a right curve to a left curve by rotating the track section 60 by 180°.

A sharper curve such as the S-curve track section 62 shown in FIG. 10 requires a special design therefore. Such an S-curve track section 62 is particularly desirable for beltways travelling through scenery which includes, for example, town traffic or traffic on rural roads. Rollers 64 are assembled to a bracket 66 (shown in FIG. 12) which is attached by screws or the like 68 to the housing 22. The rollers 64 are assembled between an upper surface and a lower surface to form the bracket 66 which is then secured to the housing 22 at the point of curvature. Two brackets 66 having rollers 64 are required for each curve; one bracket is for the inside edge of the track section at the curved section, and the other bracket is for the outer edge. The basic construction for the rollers 64 and the bracket 66 is identical for right or left curves. The rollers 64 may be constructed of a nylon, 3/16-inch diameter material or other size as is necessary to accommodate the shape of the track section 62.

Another embodiment of the invention provides for a gentle incline of the track section when adjacent sections of track are built in gradients. That is, a level gradient track section 70, positive gradient track section 72 and negative gradient track section 74 may be implemented between sections of a track to form the beltway. In addition, the positive gradient track section 72 and the negative gradient track section 74 may also be built with gentle curves and/or S-curves such as those previously described with reference to FIGS. 9 and 10 including using rollers 64 attached by brackets 66 as required.

As illustrated in FIGS. 14 and 15, intersections may be formed between track sections such as a four-way intersection illustrated in FIG. 14. The intersection has an obscured area 20 at the junction of the four track sections 76. A single timing belt 78 connects the drive pulleys 80 as shown in FIG. 14. Forwarding belts of the track sections 76, therefore, advance in synchronized unison with one another since each track section 76 may be connected by the timing belt 78 driven by a common motor (not shown).

Similarly, an obscured area 20' is shown in FIG. 15 connecting three track sections 82. Again, a single timing belt 84 may connect the drive pulley 86 for advancement of racing elements (not shown) connected to posts which, in turn, may be connected to a forwarding belt as previously discussed with respect to FIGS. 5–7. It should be understood that any number of track sections may be used to meet at a common junction point/obscured area between the track sections.

FIGS. 16 and 17 illustrate an alternate embodiment for the advancement of racing elements on a track section, particularly curved track sections. As shown in FIG. 17, a forwarding belt 100 having a round cross-sectional area is secured between a small roller 102 and a larger center roller 104 for advancement of the forwarding belt 100. Such a belt configuration is required for curved and straight sections including gradients as illustrated in FIG. 13. The forwarding belt 100 allows for three-dimensional movement of the racing elements (not shown) on the posts 106. The belt 100, as illustrated, is approximately 3/16-inch and, preferably, may be constructed of a polyurethane although other materials may, as well, be used. The posts 106 may be integrally formed with the forwarding belt 100 or separately inserted and attached so as to travel within a groove 108 of the housing 110.

The track section 98, as illustrated in FIG. 16, may be separated from or connected to adjacent track sections by inserting or removing semi-flexible pins (not shown) into holes 112 formed at each end of the track section 98 for adjoining an adjacent track section. The track section 98 may then be secured to the housing 110 through the holes 114 by using screws or other attaching means.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A beltway system for advancing at least one racing element on each one of a plurality of tracks, the system comprising:

a housing having a top wall, a first end and a second end with a slotted section in the housing forming the plurality of tracks wherein adjacent tracks of the plurality of tracks approach at a common junction substantially at a midpoint intermediate the first end and the second end;

an apertured formation obscuring the common junction between the plurality of tracks at the midpoint intermediate the first end and the second end;

a forwarding belt for each of the plurality of tracks operatively connected to respective racing elements for advancement thereof such that each of the racing elements appears to be travelling an entire length of the housing from the first end to the second end as the elements enter and exit the apertured formation;

a motor attached within the housing;

a timing belt;

a primary pulley operatively connected to the motor; and forwarding belts of each track wherein the timing belt operatively connects each of the secondary pulleys with the primary pulley for synchronized control of the forwarding belts for each of the tracks.

2. The beltway system of claim 1 wherein the tracks include curved sections.

3. The beltway system of claim 1 wherein the tracks include positive gradients and/or negative gradients.

4. The beltway system of claim 1 wherein at least three tracks intersect at the common junction.

5. The beltway system of claim 1 wherein the housing includes scenery mounted thereon.

6. The beltway system of claim 1 wherein the obscuring formation is removably constructed and arranged on the housing to prevent observance of the racing elements on adjacent tracks after entering and before exiting the formation.

7. The beltway system of claim 1 further comprising a plurality of posts removably attached at one end to the forwarding belt and removably attached at its opposite end to the racing element wherein the post extends through the top wall of the housing.

8. The system of claim 1 wherein the forwarding belt has a rectangular cross-sectional area.

9. The system of claim 1 wherein the forwarding belt has a circular cross-sectional area.

10. The system of claim 1 further comprising bracketed rollers at curved sections of the tracks.

11. A method for controlling a plurality of miniaturized racing elements through scenery on a model beltway system comprising the steps of:

providing at least two substantially oval track sections on a housing having a first end and a second end, each of the substantially oval track sections having at least one of the plurality of miniaturized racing elements thereon;

providing forwarding belts for each of the track sections for advancement of each of the racing elements on their respective track sections wherein the forwarding belts are operatively connected to a motor; and providing a structure substantially at a midpoint intermediate the first end and the second end of the housing having the track sections thereon for obscuring an area about which the racing elements change their track direction on their respective track sections such that the track sections appear to be continuous and further such that each of the at least one of the plurality of miniaturized racing elements appears to be traveling an entire length of the housing from the first end to the second end.

12. The method of claim 11 wherein at least a portion of the track sections include a curve.

13. The method of claim 11 wherein at least a portion of the track sections includes a gradient.

14. The method of claim 11 wherein at least three track sections intersect at a common junction.

15. The method of claim 11 further comprising the steps of:

connecting a timing belt to a primary pulley controlled by the motor and connecting the timing belt to a plurality of secondary pulleys; and connecting the forwarding belt of each of the track sections to the corresponding secondary pulleys for advancing the racing elements on the track sections.

* * * * *